US011448206B2

(12) United States Patent
Armacanqui et al.

(10) Patent No.: US 11,448,206 B2
(45) Date of Patent: Sep. 20, 2022

(54) GAS LOCK REMOVAL METHOD FOR ELECTRICAL SUBMERSIBLE PUMPS

(71) Applicants: Jesus S. Armacanqui, Houston, TX (US); Paul A. Munding, Jr., Houston, TX (US); Nick Martin, Houston, TX (US)

(72) Inventors: Jesus S. Armacanqui, Houston, TX (US); Paul A. Munding, Jr., Houston, TX (US); Nick Martin, Houston, TX (US)

( * ) Notice: Subject to any disclaimer, the term of this patent is extended or adjusted under 35 U.S.C. 154(b) by 11 days.

(21) Appl. No.: 16/836,149

(22) Filed: Mar. 31, 2020

(65) Prior Publication Data

US 2021/0301813 A1 Sep. 30, 2021

(51) Int. Cl.

| | |
|---|---|
| ***F04B 47/06*** | (2006.01) |
| ***F04B 49/20*** | (2006.01) |
| ***F04B 49/22*** | (2006.01) |
| ***F04D 13/08*** | (2006.01) |
| ***F04D 15/00*** | (2006.01) |
| ***F04D 15/02*** | (2006.01) |
| *E21B 43/12* | (2006.01) |
| *F04C 13/00* | (2006.01) |

(52) U.S. Cl.

CPC ..... *F04B 47/06* (2013.01); *F04B 49/20* (2013.01); *F04B 49/225* (2013.01); *F04D 13/086* (2013.01); *F04D 15/0022* (2013.01); *F04D 15/0066* (2013.01); *F04D 15/0209* (2013.01); *E21B 43/128* (2013.01); *F04B 49/22* (2013.01); *F04C 13/008* (2013.01)

(58) Field of Classification Search

CPC ..... F04B 47/06; F04B 49/20; F04B 49/225; F04B 49/22; F04D 13/086; F04D 15/0022; F04D 15/0066; F04D 15/0209; E21B 43/128

USPC ..... 417/26–31, 423.3

See application file for complete search history.

(56) References Cited

U.S. PATENT DOCUMENTS

| | | | | |
|---|---|---|---|---|
| 6,167,965 | B1 * | 1/2001 | Bearden | E21B 43/128 417/18 |
| 9,822,624 | B2 | 11/2017 | Wang et al. | |
| 2009/0065202 | A1 | 3/2009 | Brown et al. | |
| 2012/0027630 | A1 * | 2/2012 | Forsberg | F04D 15/0088 73/24.06 |
| 2013/0175030 | A1 | 7/2013 | Ige et al. | |

(Continued)

FOREIGN PATENT DOCUMENTS

WO WO 2013/130536 A1 * 9/2013

*Primary Examiner* — Charles G Freay

(74) *Attorney, Agent, or Firm* — Law Office of Jeff Williams PLLC; J. Oliver Williams

(57) ABSTRACT

Embodiments of the present invention disclose a method, a computer program product, and a system for removing gas locking in a pump. The method includes setting the pump into a gas interference condition based on a variable speed drive driving a pump at a first frequency and a choke valve set at a first restriction value and adjusting the variable speed drive to a second frequency and the choke valve to a second restriction value such that the adjustment produces a back-pressure that lets free gas get dissolved in a fluid phase and keeps fluids drawn by the pump at a single-phase flow based on pressure-volume-temperature characteristics of the fluids.

9 Claims, 6 Drawing Sheets

(56) References Cited

U.S. PATENT DOCUMENTS

| | | | | |
|---|---|---|---|---|
| 2016/0084254 | A1* | 3/2016 | Dowling | F04D 27/004 417/44.2 |
| 2016/0281479 | A1* | 9/2016 | Rendusara | E21B 47/008 |
| 2019/0063194 | A1 | 2/2019 | Berland | |

* cited by examiner

GAS LOCK REMOVAL METHOD FOR ELECTRICAL SUBMERSIBLE PUMPS

BACKGROUND OF THE INVENTION

1. Field of the Invention

The present application relates to crude oil extraction from production wells, and more particularly to electrical submersible pumps for pumping crude oil from an oil reservoir to surface level.

2. Description of Related Art

There have been many attempts to solve the problem of handling high gas content in crude oil in conjunction with standard electrical submersible pumps (ESP) and rotary gas separators. For most applications in conventional wells that rarely produce high gas content, standard rotary gas separators (RGS) have successfully been used to separate gas prior to entering into a pump. In a similar principle performed by centrifuges, RGS work by rotationally accelerating an oil and gas mixture into a vortex where then the mixture is separated into a density gradient due to the acceleration. As a result, the gas, being less dense than the oil, accumulates towards the axis of rotation, leaving the denser oil behind to be pumped away.

A patented separator using a vortex design tries to improve the separation efficiency by using gas discharge tubes that extend from the separator out through the shroud. The gas discharge tubes are tangentially aligned to create a vortex on the exterior of the shroud which increases the passive separation of the fluid by causing coalescing of bubbles in the fluid. While this method attempts to improve the efficiency of the standard RGS, it marginally improves separation efficiency by only allowing a partial amount of gas to separate. Typically this results in a Gas Oil Ratio (GOR) value of less than 500 scf/barrel, which is not enough for most wells encountered in unconventional reservoirs that produce with a GOR above 1,000 scf/barrel in the transition period from early flow back to late-life production stage.

On the other end of the device, a standard impeller vane of a standard pump impeller design (radial or mixed flow types) creates zones of high pressure and zone of low pressure. Gas entering the pump tends to accumulate and grow in the low-pressure zone and extends into the high-pressure zones until it fully displaces all liquids along the impeller vanes, thus leading to gas interference and a gas lock effect. In other words, the concentration of gas along the impeller prevents any liquids from being impelled through the pump, effectively jamming the pump from effectively move liquids. In an attempt to prevent this, impellers with a special split vane blade design are installed in the lower stages of the pump in order to create turbulent flow. While this approach in ESP application works fine for conventional oil wells, similar applications in unconventional reservoirs that have abrasives present (e.g., proppant flow back sand) greatly adversely affect pump lifetime. Experiments conducted have shown the effect of erosion on pumps having the split vane design while pumping fluids containing gas and proppant sand. Given that the pump discharge pressure head is generated by the geometry of the impeller, mechanical erosion reduced the delivered pressure head. Experiments carried out at a Gas Volume Fraction (GVF) of 20% showed a 50% performance reduction after 66 hours of operation only. This effect is attributed to the increased shear due to phase separation and reduced lubricity due to gas accumulation. Furthermore, experiments have shown that the first stages of the pump are the most affected. This is explained by the upper stages of the pump having less gas due to higher pressures, and that sand that reaches the upper stages are smoother as a result of mutual erosion between the sand and the lower stages of the pump.

There have also been attempts to solve the high gas content problem by installing additional gas handling devices on top of the RGS prior to the actual production pump. These attempts resulted in the installation of additional components in the ESP downhole string. While their principle of functioning is different than that of the RGS, it aims to homogenize the oil gas mixture by breaking larger burbles into smaller ones prior to entering the producing pump.

The most difficult operating conditions of the ESP pump include the effect of high gas production, the occurrence of low bottom hole flowing pressure Pf, and a low well production rate. For those conditions, a proposed configuration calls for a combined installation of tandem separators (two rotary gas separators), and a boosting multi-vane pump before the actual producing pump. This system is encapsulated in a shroud claiming to handle a higher GVF, provided the casing or liner size enables the installation, which is rarely the case for most unconventional shale oil wells that are installed in a 5½-inch casing. While these configurations are an improvement as compared to the sole use of an RGS, handling a pump intake GVF of up to 75% that typically corresponds to GOR values of 1,500 to 2,000 scf/barrel comes at a premium cost. In operation, the above configurations composed of the standard RGS (sometimes two used in tandem), the advanced gas handling device, and the producing pump section each have different GVFs to manage. While the producing pump has a low GVF, the components below (right after the intake holes) have a higher GVF value. An operating environment having sand or solids accelerates the erosion and premature wear of the components located lower in the string.

Another factor to consider is the unsteady flow behavior when producing from long horizontal undulated wells typically found in shale oil applications. Impedances along horizontal wellbores lead to the occurrence of a 100% GVF at the pump intake for a short period of time in the form of gas slugging, which results in interference and gas locking, subsequently interfering with normal pump operation due to electrical trips, oil deferment, and reduced pump lifetime. The frequency and size of the gas slugs are influenced by the produced liquid and gas rates as well as the wellbore geometry. In light of the occurrence of the said gas slugs in unconventional shale oil wells, the installing of additional gas handling devices on top of the RGS does not ensure the prevention of gas locking given their GVF limitations.

There have also been attempts to solve the high gas content problem by implementing procedures that select appropriate process operational variables. Traditionally variable speed drives (VSD) were introduced in the field to overcome the uncertainty on the actual producing rate of the well. The broad frequency range of variation of the VSD allows the user to operate the pump within a recommended operating envelope. The need for the use of VSDs for the operation of wells in unconventional shale oil reservoirs arises due to the observed steep production decline and gas rate increment through the well life. While the standard VSD operating mode sets a fixed value for the frequency value (i.e., the frequency mode), the passing of gas through the pump results in a decrease in pump amperage. Further gas surges are reflected in erratic pump amperage until the pump trips due to underload. The controlling capabilities of the ESP pump operation using VSDs to avoid gas locking allows the application of a "current mode" (also called an "I-limited mode"). In this mode, a pump amperage value is fixed and the VSD automatically varies the frequency to maintain the set amperage while the pump is affected by accumulated gas. Similarly, a pump intake pressure (PIP) value can also be set to a fixed value, and the frequency will vary to try to maintain the set PIP.

While these VSD operating modes can delay the occurrence of gas interference and gas lock for a limited time, these events inevitably occur. The resulting periods of low flow rate lead to an electrical trip of the ESP due to high motor temperature, and the repetitive trips can then lead to pump failure.

During the operation of unconventional shale oil wells, drastic changes in reservoir conditions occur, including gas content in the produced fluid and gas slugs that lead to gas lock. Some attempted solutions known in the art have tried incorporating a procedure to automatically recognize the occurrence of a gas lock event and automatically reduce the frequency in order to enable some degree of restoration of the PIP in an attempt to reduce the gas amount entering the pump. Once the pressure restores, the pump is accelerated to try to clear the gas out of the pump. If there are repetitive trips, a protection loop triggers the pump shut down for an extended period to protect the ESP motor from thermal overload. However, for production wells that face large gas slugs, high GOR values, or low PIP, this approach does not completely avoid electrical trips due to gas lock.

Another approach is to control several types of electrical trips, such as trips due to solids, paraffin, low inflow, gas, etc. Concerning the gas lock condition, the system integrates data from sensors, and simulators perform calculations to determine limits of gas production based on the type of installed RGS and advanced gas handling devices. Based on these determinations, the ESP controller increases or decreases the frequency via the VSD only. In the case of decreasing the frequency to avoid gas interference and/or gas locking, the operator sacrifices on oil production. As this approach utilizes existing gas handling equipment that has known gas handling limitations, oil remains stranded.

Another approach incorporates the monitoring of the surface parameters in order to integrate them with the operation of the controller. This approach starts and stops a well based on pressure transducers that are installed before and after a control valve along the annular flow line in order to control the gas flowing through the casing according to the well production behavior. While this approach improves the process of starting and stopping a well (in contrast to the use of a pump off controller (POC), which is based on a timer clock set by a well operator), this approach is based on the casing pressure response which increases depending on the flow of gas via the casing annular space, which is typical of a well that use gas separators of low efficiency (e.g., gas separators utilized in bean pumps that rely mainly on gravity segregation as opposed to RGS and advance separators used in ESP wells). In ESP wells, gas is produced by both the tubing and the casing line so that the sole focus on the casing line does not capture the total influx and its effect on ESP pump operation, such as gas locking.

Lastly, another approach proposes a method to reduce the impact of the vapor phase in the ESP pump operation in production wells using a method of Steam-Assisted Gravity Drainage (SAGD) that enhances oil recovery of heavy crude oil and bitumen. This approach uses a restriction in the annulus of the well to regulate the amount of flowing steam through the casing. Furthermore, the approach includes adjusting a casing gas blower and/or pump rate based on a comparison between a detected dynamic fluid level and a pre-set target dynamic fluid level in order to regulate the amount of flowing steam through the casing to optimize well production. Since this approach is based on the casing pressure response, which influences the position of the fluid level in the annulus space, this method does not consider or monitor the amount of gas flowing into the tubing that leads to gas locking.

Although strides have been made to improve gas lock avoidance in ESPs used in production wells, shortcomings to these solutions still remain. Thus, a cost-effective method and system are desired to overcome the challenges presented by gas locking while reducing pump wear and downtime.

BRIEF SUMMARY OF THE INVENTION

It is an object of the present application to provide a method, a computer program product, and a system for removing gas interference and gas locking in a pump, the method comprising: setting the pump into a gas interference condition by setting a variable speed drive driving the pump at a first frequency and a choke valve is set at a first restriction value, and adjusting the choke valve to a second restriction value and the variable speed drive to a second frequency such that the second restriction value produces a greater pressure within the flowline upstream from the choke valve than the first restriction value, the second frequency is greater than the first frequency, and wherein the adjustment produces an additional backpressure at the pump discharge that lets free gas get dissolved in the fluid phase and keeps fluids drawn by the pump at a single-phase flow based on pressure-volume-temperature characteristics of the fluids.

Another object of the present application is to provide a method wherein the second restriction value and the second frequency correspond to a pump intake pressure of the pump that is equal to a pump intake pressure during a gas condition of the pump having the choke valve at the first restriction value.

Another object of the present application is to provide a method wherein the choke valve and the variable speed drive are adjusted simultaneously.

Ultimately the invention may take many embodiments. In these ways, the present invention overcomes the disadvantages inherent in the prior art.

The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the various purposes of the present design. It is important, therefore, that the claims be regarded as including such equivalent constructions in so far as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
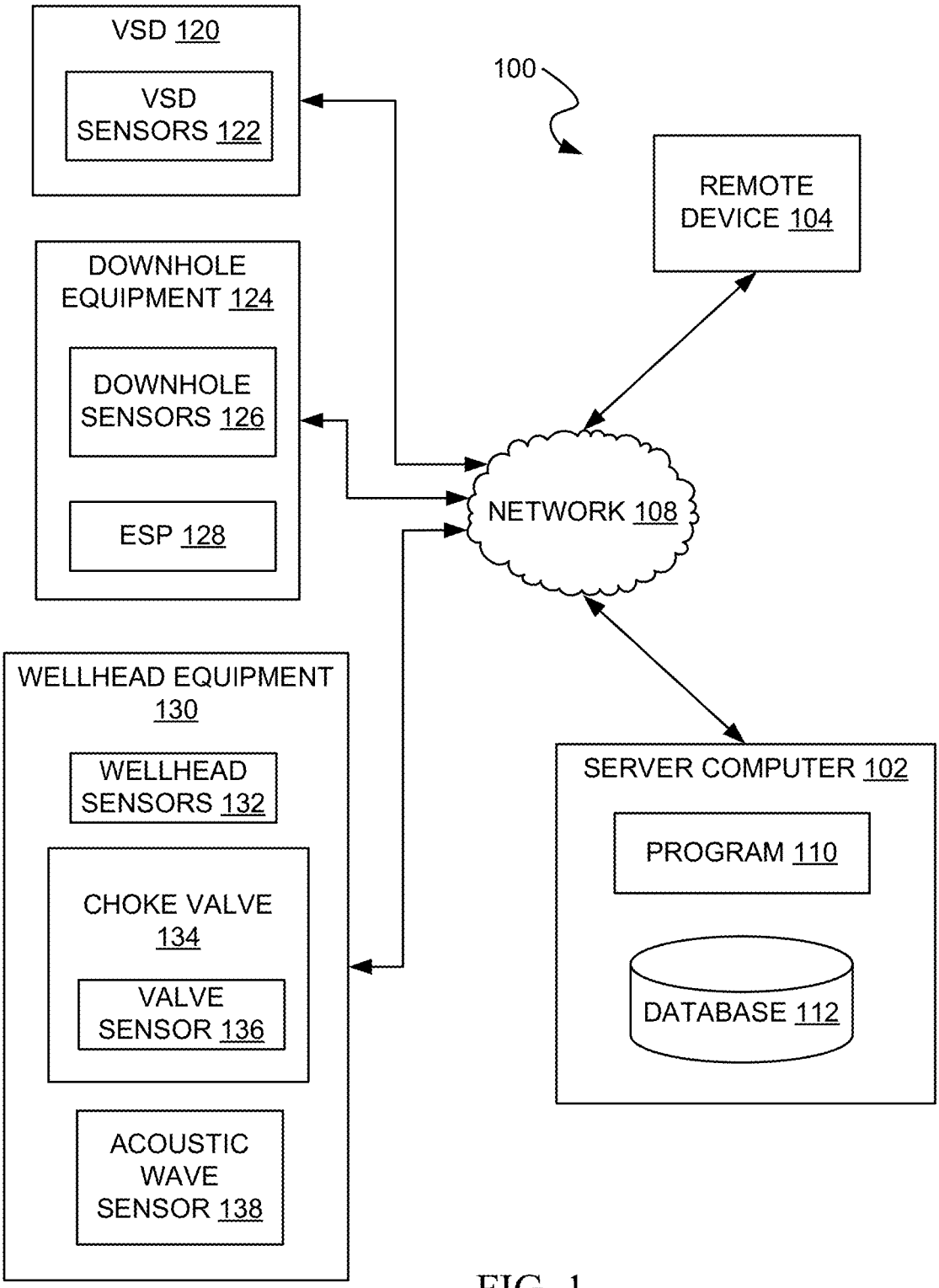
FIG. 1 is a functional block diagram illustrating a network environment, in accordance with an embodiment of the present application.

While the embodiments of the present application are susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The method in accordance with the present invention overcome one or more of the above-discussed problems associated with gas locking in electrical submersible pumps (ESP) during oil well production. In particular, the system of the present invention adjusts a frequency of a variable speed drive and restriction of a choke valve of an oil production experiencing gas locking in order to avoid gas interference and gas locking that generally occurs in the operation of ESP pumps when lifting a multi-phase fluid (e.g., a fluid composed of gas, water, and hydrocarbon oil) from unconventional shale oil wells having high gas content which previously lead to frequent pump shutdown, oil deferment, and premature failures as a result of the limitations of existing gas separation devices. Furthermore, the method may also be used for conventional oil wells having a high gas content as well as gas wells having a high water and/or condensate.

The present invention is a method that includes an ESP that provides lifting head pressure while a chock restriction valve and a variable speed drive (VSD) gradually build back pressure that acts on each stage of the pump. The backpressure supplied by the choke restriction valve and the VSD are synchronized and are controlled based on ESP motor amperage data and acoustic wave data trend responses of fluid flow measured downstream from pump discharge. The resulting backpressure turns a multiphase flow into a single-phase flow by pressurizing the gas to dissolve into solution with the petroleum crude oil according to the Pressure-Volume-Temperature (PVT) phase behavior of hydrocarbons. By pressurizing the blend into a single-phase form, gas accumulation within the pump is prevented, thus the system avoids and removes gas locking within the pump, stops electrical pump trips, and increases pump efficiency.

Prior attempts to resolve gas locking have different limitations which lead to associated expenditures in purchasing additional downhole components in combination with existing ESP downhole pump string. In contrast, the presented method and assembly does not require any downhole well intervention or installation of additional downhole gas handling devices other than the standard RGS. In general, the method presented herein may be applied to unconventional shale oil wells, unconventional wet gas or gas condensate (retrograde gas) wells, coalbed methane wells, conventional oil wells, and conventional wet gas or gas condensate (retrograde gas). The method may also be applied to both land and offshore wells. Furthermore, the well can be vertical, horizontal, multilateral, stimulated with a single/multiple fracture(s) or chemically stimulated, or both. The incumbent well can be an existing well or a recently or new to be drilled well.

The method disclosed herein can be used in an existing well that has a running ESP pump. For the case of a new string to be installed in an existing or new well, the design of the ESP motor can incorporate a high wellhead pressure in order to have a sufficient number of stages to generate the required head when the VSD speeds the motor. For the installation of a new or replacement string, the installation of downhole injection capabilities of water or oil as an alternative to mitigate the rate reduction due to lowering inflow from the well and ensure motor cooling, will expand the application of the present invention. The installation of the ESP downhole system with a shroud is also a valid alternative. Furthermore, the combination of downhole injection and the use of a shroud is a valid alternative.

Downhole separation system: the separation system can include, RGS, two RGS separators in tandem, or an RGS and an advanced gas handler such as a tapper pump, or an encapsulated separator that uses a shroud or a multi-vane pump, or a combination.

Advanced monitoring tools include the use of a microphone recorder attached to a surface flow line to characterize a flow pattern, an ammeter to record a motor load in digital or analog form (such as the Bristol's recorder), and pressure and temperature sensors which can be analog or digital with cable connection or wireless.

Downhole pump: besides with an ESP, the method can be used in a well operated by a long-stroke pumping system (e.g., mechanical rod-beam pump (BP) or sucker rod pumping) or progressive cavity pump (PCP). For positive displacement pumps, the installation of a high-pressure stuffing box and pressure protection switches are added as part of surface accessories.

The method and system will be understood from the accompanying drawings, taken in conjunction with the accompanying description. Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments are expressly contemplated herein so that one of ordinary skill in the art would appreciate from this disclosure that the features, elements, and/or functions of one embodiment may be incorporated into another embodiment as appropriate unless otherwise described.

The system of the present application is illustrated in the associated drawings. As used herein, "system" and "assembly" are used interchangeably. It should be noted that the articles "a", "an", and "the", as used in this specification, include plural referents unless the content clearly dictates otherwise. Additional features and functions are illustrated and discussed below.

Referring now to FIG. 1, a functional block diagram illustrating a network environment, generally designated 100, is depicted in accordance with one embodiment of the present invention. FIG. 1 provides only an illustration of one implementation and does not imply any limitations with regards to the environments in which different embodiments may be implemented. Many modifications to the depicted environment may be made by those skilled in the art without departing from the scope from the invention as recited by the claims.

Network environment 100 includes server computer 102, remote device 104, VSD 120, downhole equipment 124, and wellhead equipment 130, all interconnected over network 108. Server computer 102 and remote device 104 can be a standalone computing device, a management server, a webserver, a mobile computing device, or any other electronic device or computing system capable of receiving, sending, and processing data. In other embodiments, server computer 102 and remote device 104 can represent a server computing system utilizing multiple computers as a server system, such as in a cloud computing environment. In another embodiment, server computer 102 and remote device 104 can be a laptop computer, a tablet computer, a netbook computer, a personal computer (PC), a desktop computer, a personal digital assistant (PDA), a smart phone, or any programmable electronic device capable of communicating with various components and other computing devices (not shown) within network environment 100. In another embodiment, server computer 102 and remote device 104 each represent a computing system utilizing clustered computers and components (e.g., database server computers, application server computers, etc.) that act as a single pool of seamless resources when accessed within network environment 100. Server computer 102 and remote device 104 may include internal and external hardware components capable of executing machine-readable program instructions, as depicted and described in further detail with respect to FIG. 6. In some embodiments, server computer 102 and remote device 104 may be a single device. In some embodiments, server computer 102 and VSD 120 may be a single device. In alternate embodiment, server computer 102 is a Programmable Logic Controller (PLC). In some embodiments, server computer 102 manages a plurality of wells (e.g., 20 or 30 oil wells).

In general, server computer 102 is a control system for operating VSD 120, downhole equipment 124, and wellhead equipment 130. Remote device 104 is a device that is generally operated from a remote distance from VSD 120, downhole equipment 124, and wellhead equipment 130. In another embodiment, remote device 104 can be a manned or unmanned control room.

Server computer 102 includes program 110 and database 112. In general, program 110 monitors for gas interference and gas locking as well as controls a frequency outputted by VSD 120 and a restriction value produced by choke valve 134, each based on data received from sensor components corresponding to VSD 120, downhole equipment 124, and wellhead equipment 130. Program 110 puts a pump in a state that avoids gas locking by setting the pump into a gas interference condition and adjusting simultaneously a restriction of a choke valve and a frequency outputted by a variable speed drive that drives the pump, wherein adjustment of the restriction of the choke valve and the frequency outputted by the variable speed drive results in a backpressure that keeps a fluid drawn by the pump at a single-phase flow, thereby avoiding gas locking.

Database 112 is a repository for data accessible by program 110. Database 112 can be implemented with any type of storage device capable of storing data and configuration files that can be accessed and utilized by server computer 102, such as a database server, a hard disk drive, or a flash memory. Database 112 stores data recorded by sensor components corresponding to VSD 120, downhole equipment 124, and wellhead equipment 130 as well as setting for driving components of VSD 120, downhole equipment 124, and wellhead equipment 130.

VSD 120 is a variable speed drive (VSD) controlled by program 110 that outputs a driving frequency (also referred to as "a frequency) for a motor associated with a pump as part of downhole equipment 124. Furthermore, VSD 120 includes VSD sensors 122. Sensors 122 are sensors that collect data associated with VSD 120 including, but is not limited to, frequency, voltage, and current outputs of the VSD.

Downhole equipment 124 is a culmination of equipment associated with an oil well located downhole. In general, downhole equipment 124 may include, but is not limited to, one or more pumps, one or more electric motors, and one or more rotary gas separators (RGS). Furthermore, downhole equipment 124 includes, but is not limited to, downhole sensors 126 and ESP 128. Sensors 126 are sensors that collect downhole equipment data associated with downhole equipment 124 including, but is not limited to, pump intake pressure, pump discharge pressure, motor winding temperature, motor oil temperature, pump vibration, and current leakage. In general, ESP 128 is an electrical submersible pump (ESP) that includes a motor and a pump that is driven by a frequency supplied by VSD 120. However, alternatively, ESP 128 may also be, but is not limited to, a long-stroke pumping system or a progressive cavity pump.

Wellhead equipment 130 is a culmination of surface-level equipment associated with an oil well generally located proximately to a wellhead. Wellhead equipment 130 includes wellhead sensors 132, choke valve 134, and acoustic wave sensor 138. Wellhead sensors 132 are sensors that collect equipment data associated with wellhead equipment 130 including, but is not limited to, flowline pressures corresponding to various stages of a flowline and flowline temperature.

Choke valve 134 is a control valve generally known in the art that controls a rate of flow along the flowline as well as producing a downstream flowline pressure that is lower than an upstream flowline pressure measured relative from the choke valve. As used herein, the amount of restriction a choke valve produces on a flow line is further referred to as a restriction value. Choke valve 134 can be a mechanical, electromechanical (i.e., a mechanical valve driven by electrical actuators, servos, or solenoids), pneumatic, or hydraulic valve operated by hand by a user or by program 110 via servos or actuators. Furthermore, choke valve 134 includes a valve sensor 136 that collects data regarding a current state of the restriction value of choke valve 134. For example, valve sensor 136 can be a position sensor that measures either an opening of the choke valve resulting from a position of a needle in relation to a seat of the choke valve, the position of the sleeve opening, or a ball-valve handle orientation associated with a choke valve, wherein the orientation of the ball-valve corresponds to a restriction value produced by the choke valve. Alternatively, a restriction value of the choke valve may be determined by a measured pressure differential between the upstream and the downstream flowline pressures based on a corresponding set of pressure transducers (i.e., wellhead sensors 132) located along the flowline.

Acoustic wave sensor 138 is an acoustic wave sensor located along the flowline that collects data corresponding to flowline acoustics. Program 110 determines when ESP 128 is in a gas interference or a gas lock state based on data collected by acoustic wave sensor 138 and VSD sensors 122 by determining that motor amperage drawn by ESP 128 (measured by VSD sensors 122) deviates from a steady current to an unstable/oscillating current and flowline acoustics (measured by acoustic wave sensors 138) indicate gas burbling within the flow (i.e., symptoms that confirm the pump is failing to draw fluid due to gas presence within the pump).

Network 108 can be, for example, a telecommunications network, a local area network (LAN), a wide area network (WAN), such as the Internet, or a combination of the three, and can include wired, wireless, or fiber-optic connections. Network 108 can include one or more wired and/or wireless networks that are capable of receiving and transmitting data, voice, and/or video signals, including multimedia signals that include voice, data, and video information. In general, network 108 can be any combination of connections and protocols that will support communications among server computer 102, remote device 104, VSD 120, downhole equipment 124, and wellhead equipment 130, and other computing devices (not shown) within network environment 100.

Figure 2:
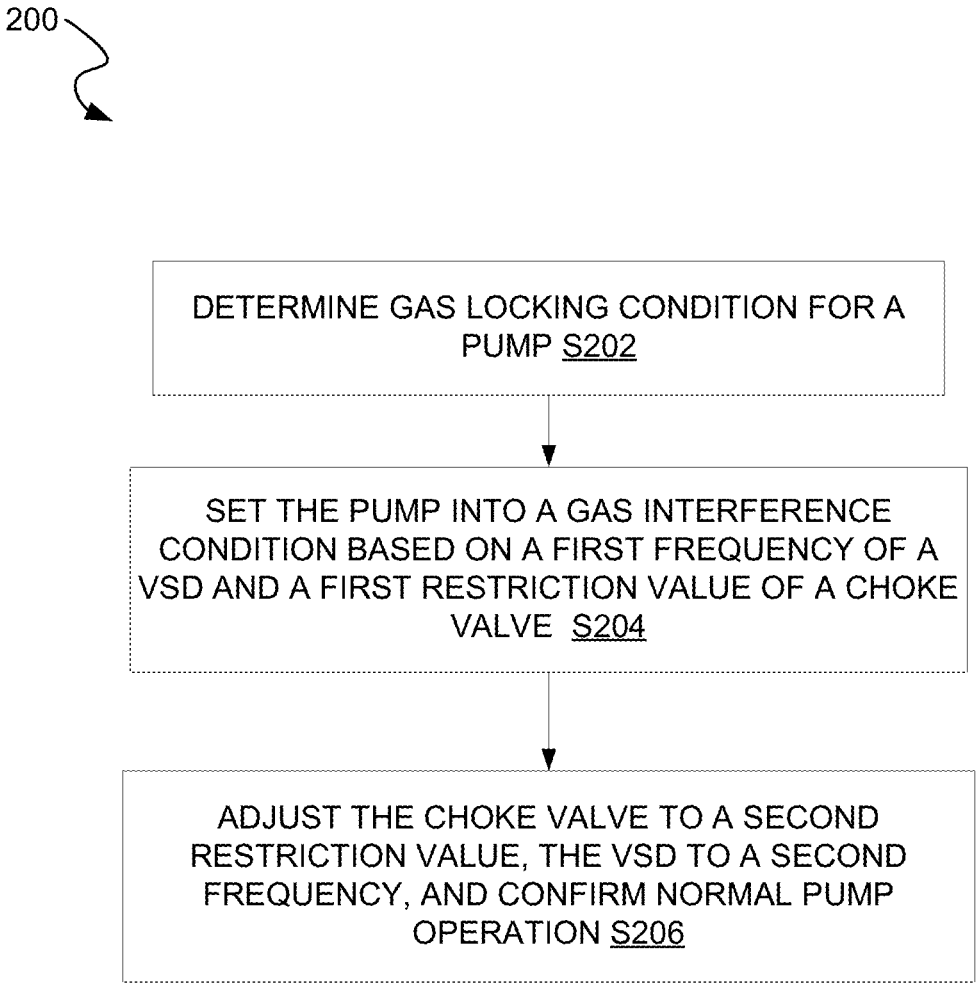
FIG. 2 is a flowchart depicting operational steps of removing gas locking conditions in a pump, in accordance with an embodiment of the present invention.

FIG. 2 is a flowchart 200 depicting operational steps of a program that removes gas locking conditions in a pump, in accordance with an embodiment of the present invention.

In step S202, program 110 determines gas locking conditions for a pump. In this embodiment, program 110 determines gas locking conditions for ESP 128 by monitoring data received from VSD sensors 122 and acoustic wave sensors 138, wherein the data includes current drawn by ESP 128 from VSD 120 and data describing flowline acoustics. Program 110 determines when ESP 128 is in a gas lock state based on data collected by acoustic wave sensor 138 and VSD sensors 122 by determining that motor current drawn by ESP 128 (measured by VSD sensors 122) deviates from a steady current to an unstable/oscillating current and flowline acoustics (measured by acoustic wave sensors 138) indicate gas burbling within the flow (i.e., symptoms that confirm the pump is failing to draw fluid due to gas presence within the pump). Once ESP 128 has entered in a gas lock state, program 110 determines a pump intake pressure of ESP 128 based on measurements received from sensors 126 of downhole equipment 124. In this embodiment, choke valve 134 is at a first restriction value during the gas locking condition. In further embodiments, program 110 monitors the parameters that characterize pump performance, identifies gas effect in a pump, assesses the severity of the gas effect, and generates alarms.

In step S204, program 110 sets the pump into a gas interference condition based on a first frequency of a VSD and a first restriction value of a choke valve. In this embodiment, program 110 sets ESP 128 into a gas interference condition based on a first frequency of VSD 120 and a first restriction value of choke valve 134, wherein the gas interference condition is a transitionary state between normal pumping conditions and gas locking conditions. In general, the first frequency is a frequency produced by VSD 120 that is less than a frequency that produces a gas locking condition.

In step S206, program 110 adjusts the choke valve to a second restriction value and the VSD to a second frequency. In this embodiment, program 110 adjusts choke valve 134 to a second restriction value and VSD 120 to a second frequency, wherein the second restriction value produces a greater pressure within the flowline upstream from choke valve 134 than the first restriction value, wherein the second frequency is greater than the first frequency. As a result of adjusting choke valve 134 to the second restriction value and VSD 120 to the second frequency, backpressure increases along the flowline between ESP 128 and choke valve 134, thereby keeping a fluid drawn by ESP 128 at a single-phase flow based on pressure-volume-temperature characteristic of the fluid. Furthermore, the second restriction value and the second frequency corresponds to a pump intake pressure of ESP 128 that is equal to the pump intake pressure during the gas locking condition determined in S202. In a further embodiment, program 110 adjusts choke valve 134 and VSD 120 to the corresponding second restriction value and second frequency simultaneously. In an alternate embodiment, adjustment of choke valve 134 and VSD 120 to the corresponding second restriction value and second frequency can be performed in fractional stepwise increments.

As program 110 adjusts the choke valve and the VSD, program 110 monitors responses in data received associated with acoustic wave readings and currents pulled by the motor. Upon achieving stability of the pump (i.e., removal of the gas lock condition), program 110 adjusts VSD settings to reflect the new stable operating condition. As a result, oil production will run undisrupted as compared to the gas interference and gas locking scenario. An additional production increase can be achieved by further reducing the pump intake pressure. How far the pump intake pressure can be reduced depends on the capabilities of the installed VSD, the transformer, the downhole motor, and the produced liquid volume for appropriate motor cooling.

Additional production increase can be achieved if the installed downhole motor has enough horsepower capacity and the surface equipment has the kVA rating to support the frequency increase at the VSD.

With the decrease of rate that is typical for the transition period of unconventional shale oil wells, the use of the present invention enables to reduce the production drop due to the limitation of an ESP pump as long as possible by the additional implementation of fluid injection via the casing in order to keep the pump operating within the pump operating envelope and to ensure good motor cooling. For instance, this can be carried out by connecting a part of the production of a neighbor well of the same cluster to the annular space of the incumbent well. Further new ESP installations can incorporate either a power cable with a capillary tube or a separate small diameter tubing to enable down hole injection below the pump.

While this method is taught with respect to actions and determination of program 110, it should be appreciated that the method described by steps S202 through S206 may also be practiced manually by a user via remote device 104 and/or onsite equipment adjustments.

As a result of this method, pump intake pressure is restored to levels where gas interference, blockage, or gas locking was previously observed. Furthermore, acoustic wave sensors record less gas burbles and pulled motor currents resume to a stabilized state.

Figure 3:
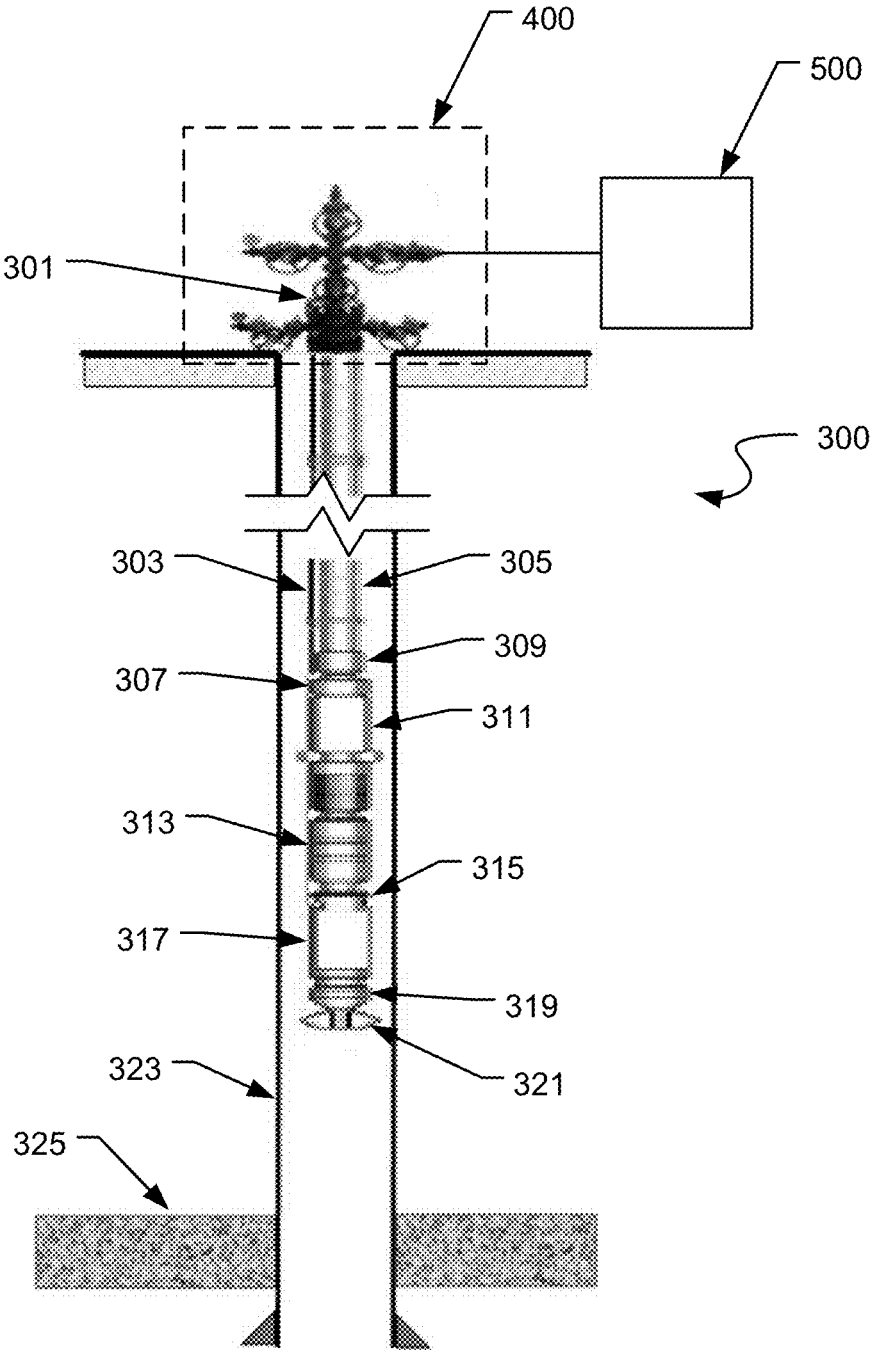
FIG. 3 illustrates a pump system environment further depicting downhole equipment, in accordance with an embodiment of the present invention.
Figure 4:
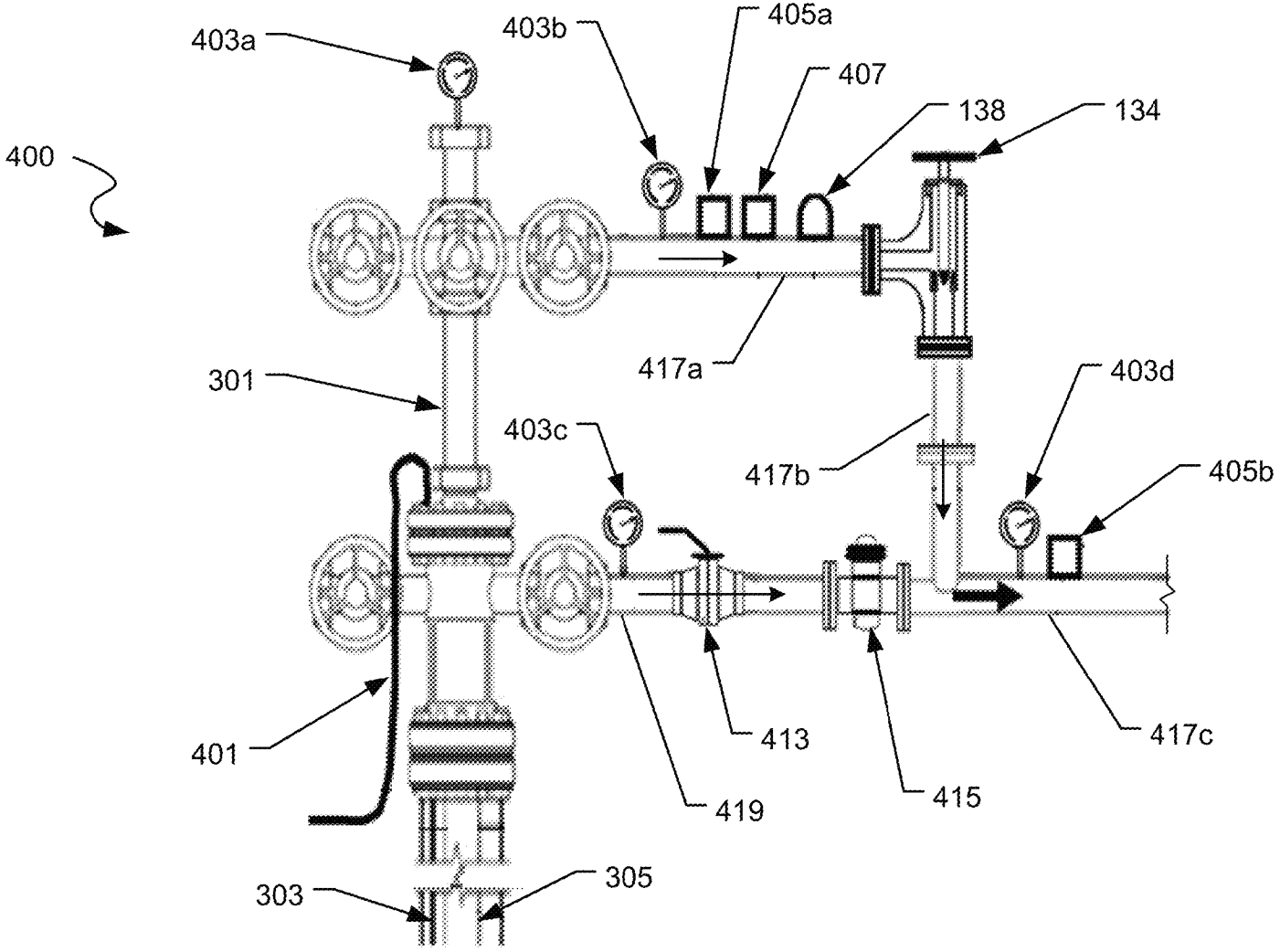
FIG. 4 illustrates a wellhead assembly, in accordance with an embodiment of the present invention.
Figure 5:
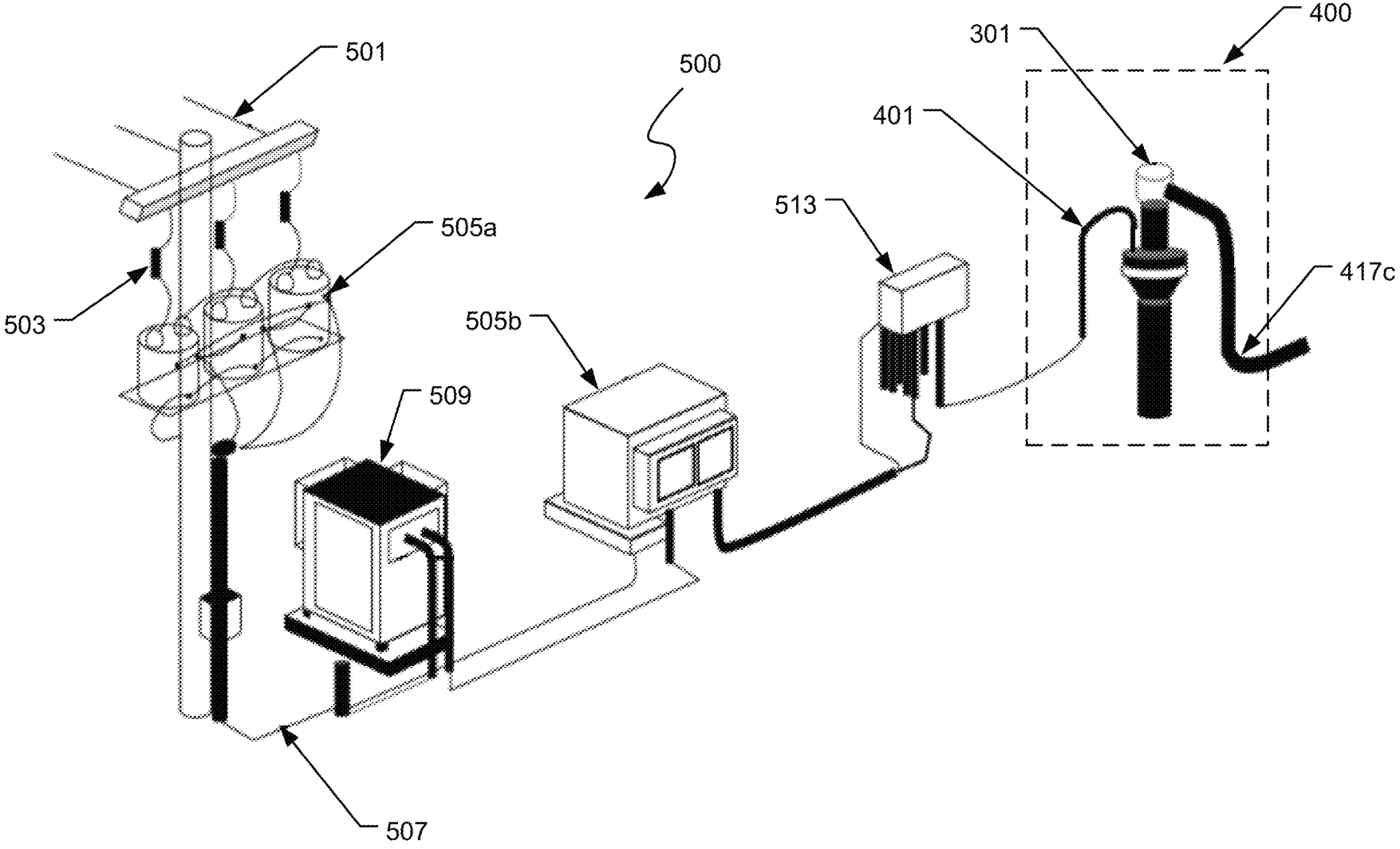
FIG. 5 illustrates a power systems environment, in accordance with an embodiment.

Now in reference to FIGS. 3-5, an exemplary assembly utilizing the method described herein is depicted in accordance with the present invention.

Referring now to FIG. 3, pump system environment 300 is depicted while further illustrating downhole equipment.

In FIG. 3, an oil well uses a standard downhole configuration using a rotary gas separator (RGS) without any additional gas handling devices prior to a producing pump. The RGS and the producing pump are both driven by a three-phase downhole motor, which is powered by a downhole electrical power cable reaching from the surface. The depicted well is a vertical well; however, the same method can be deployed in a horizontal well typically found for shale oil wells.

In this figure, wellhead 301 connects to downhole equipment located below the surface. Well casing 323 runs from wellhead 301 to a reservoir outlined by production formation 325. Wellhead 301, as well as detailed components related to wellhead 301, are further depicted and described with respect to FIG. 4. Downhole equipment (i.e., downhole equipment 124 in reference to FIG. 1) is located within well casing 323 include power cable 303, production tubing 305, pump discharge head 307, discharge pressure sensor 309, pump 311, rotary gas separator 313, seal 315, motor 317, downhole sensors 319, and motor guide 321. Power cable 303 supplies power as well as network connections to downhole equipment via wellhead 301 to power systems environment 500. Power systems environment 500 is further described and depicted with respect to FIG. 5. In general, downhole sensors 319 includes, but is not limited to, pump intake pressure sensor, pressure discharge sensors, vibration sensors, current leak sensors, motor oil sensors, and motor winding temperature sensors.

In further reference to FIG. 1, downhole sensors 126 include discharge pressure sensor 309 and downhole sensors 319, and ESP 128 includes pump 311 and motor 317.

Also in reference to FIG. 4, wellhead assembly 400 is depicted in accordance with the exemplary assembly.

In this figure, flowline 417*a* and annular line 419 extend from wellhead 301. In general, flowlines 417*a*-*c* are tubing associated with main fluid production from the well wherein fluid flows from wellhead 301, flowline 417*a*, flowline 417*b* (via choke valve 134), to flowline 417*c*. Annular line 419 is associated with an annulus casing that encases production tube 305. Annular line 419 is fitted with pressure gauge 403*c*, annular valve 413, and check valve 415, wherein check valve 415 prevents any backflow via the casing line. In some embodiments, check valve 415 is a non-return valve. Flowline 417*b* and annulus line 419 combine and flow into flowline 417*c*.

Power supply to the electrical motor (i.e., ESP 128) is provided by an electrical cable: power cable 303 and pigtail 401, wherein pigtail 401 and power cable 303 form a seamless network connection to ESP 128. Furthermore, power cable 303 and pigtail 401 permit data transmission from downhole sensors 126 (i.e., data transmission regarding pump intake pressure, pump discharge pressure, motor winding temperature, motor oil temperature, pump vibration, and current leakage).

In this figure, wellhead sensors 132 (in reference to FIG. 1) include pressure transducer 405*a*, pressure transducer 405*b*, and temperature transducer 407. Pressure gauges 403*a* and 403*b* are located on wellhead 301 and along flowline 417*a*, wherein pressure gauge 403*b* is located upstream relative to choke valve 411, pressure transducer 405*a*, and temperature transducer 407. Having two pressure gauges enables for quick and reliable onsite pressure measurements while providing the method onsite. Furthermore, pressure gauge 403*d* and pressure transducer 405*b* are located downstream from choke valve 134 along flowline 417*c*.

Acoustic wave sensor 138 is located on flowline 417*a*. Acoustic wave sensor 138 is a key component as recorded data trend of gas slugs arriving at wellhead assembly 400 is monitored while performing the method of adjusting a restriction value associated with choke valve 134 and frequency produced by VSD 120. A key element is choke valve 134, which is an adjustable choke valve that can either be manually operated or remotely operated electrically, pneumatically, or hydraulically.

In a further embodiment, well head assembly 400 can be built in a skid-mounted fashion that can be connected to the flow line via a by-pass using a separate spool. In this embodiment, field deployment becomes easier as this does not require the well to be shut down for a long time to change the existing surface configuration.

Also in reference to FIG. 5, power systems environment 500 is depicted in accordance with the exemplary assembly.

This figure illustrates connections between VSD 509 and wellhead assembly 400 as well as auxiliary connections. In this figure, VSD 509 is VSD 120 of FIG. 1. Overhead lines (OHL) 501 supply 3-phase power, which is, in turn, passed through fuses 503 and has corresponding voltage stepped down via transformers 505*a*. The stepped down power is then supplied to VSD 509 via surface power cable 507. VSD 509, in turn, outputs a frequency (determined by program 110), which a voltage corresponding to the frequency is subsequently stepped up via transformer 505*b* and routed through gas vent box 513 wherein pigtail 401 delivers the frequency to wellhead assembly 400.

Figure 6:
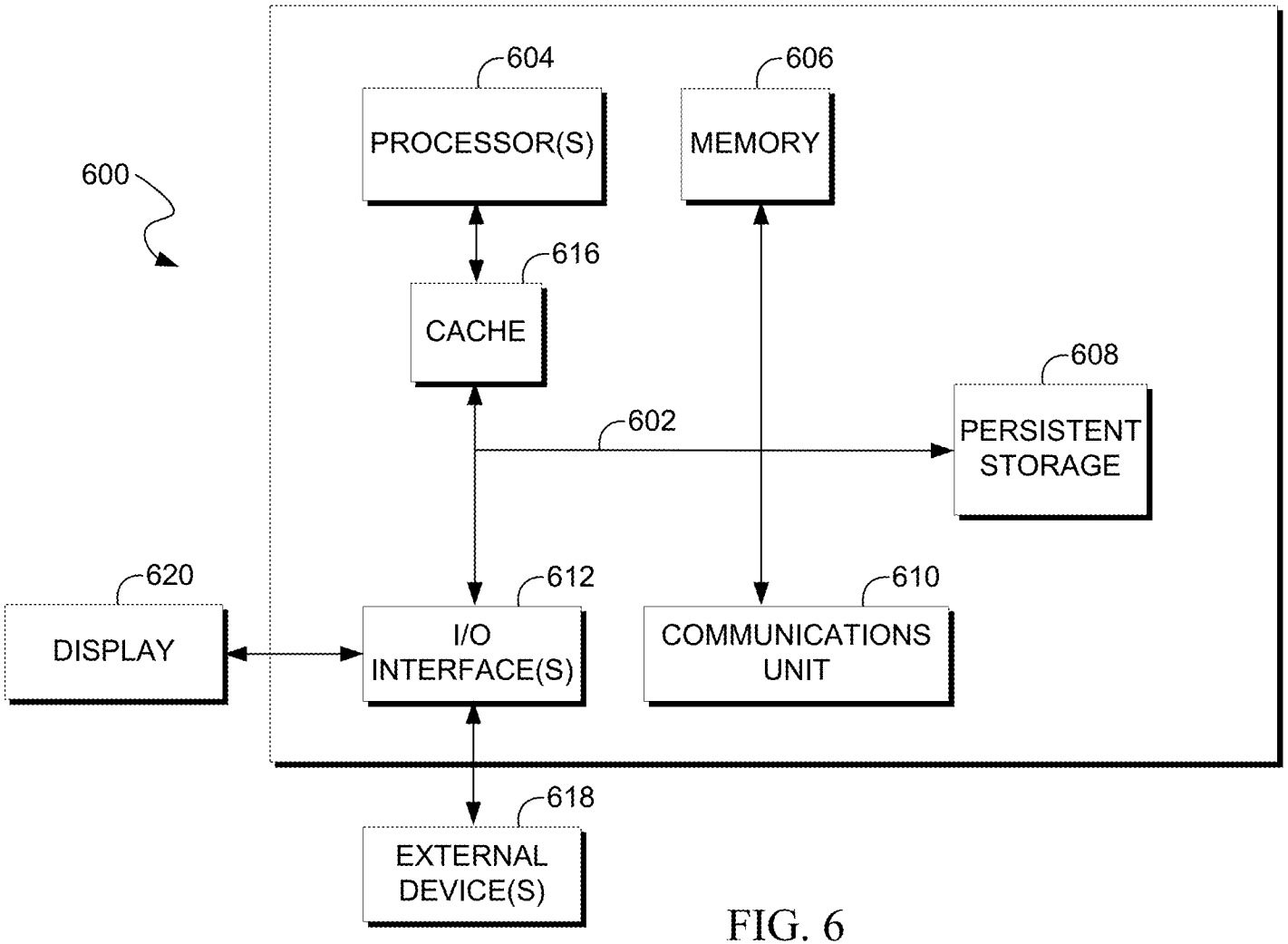
FIG. 6 depicts a block diagram of components of the computing systems of FIG. 1.

FIG. 6 depicts a block diagram of components of computing systems within network environment 100 of FIG. 1, in accordance with an embodiment of the present invention. It should be appreciated that FIG. 6 provides only an illustration of one implementation and does not imply any limitations with regard to the environments in which different embodiments can be implemented. Many modifications to the depicted environment can be made.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

Computer system 600 includes communications fabric 602, which provides communications between cache 616, memory 606, persistent storage 608, communications unit 610, and input/output (I/O) interface(s) 612. Communications fabric 602 can be implemented with any architecture designed for passing data and/or control information between processors (such as microprocessors, communications and network processors, etc.), system memory, peripheral devices, and any other hardware components within a system. For example, communications fabric 602 can be implemented with one or more buses or a crossbar switch.

Memory 606 and persistent storage 608 are computer readable storage media. In this embodiment, memory 606 includes random access memory (RAM). In general, memory 606 can include any suitable volatile or non-volatile computer readable storage media. Cache 616 is a fast memory that enhances the performance of computer processor(s) 604 by holding recently accessed data, and data near accessed data, from memory 606.

Program 110 may be stored in persistent storage 608 and in memory 606 for execution by one or more of the respective computer processors 604 via cache 616. In an embodiment, persistent storage 608 includes a magnetic hard disk drive. Alternatively, or in addition to a magnetic hard disk drive, persistent storage 608 can include a solid state hard drive, a semiconductor storage device, read-only memory (ROM), erasable programmable read-only memory (EPROM), flash memory, or any other computer readable storage media that is capable of storing program instructions or digital information.

The media used by persistent storage 608 may also be removable. For example, a removable hard drive may be used for persistent storage 608. Other examples include optical and magnetic disks, thumb drives, and smart cards that are inserted into a drive for transfer onto another computer readable storage medium that is also part of persistent storage 608.

Communications unit 610, in these examples, provides for communications with other data processing systems or devices. In these examples, communications unit 610 includes one or more network interface cards. Communications unit 610 may provide communications through the use of either or both physical and wireless communications links. Program 110 may be downloaded to persistent storage 608 through communications unit 610.

I/O interface(s) 612 allows for input and output of data with other devices that may be connected to server computer 102, borrower device 104, lender device 106, and/or cosigner device 107. For example, I/O interface 612 may provide a connection to external devices 618 such as a keyboard, keypad, a touch screen, human-machine interface (HMI) display, a microphone, and/or some other suitable input device. External devices 618 can also include portable computer readable storage media such as, for example, thumb drives, portable optical or magnetic disks, and memory cards. Software and data used to practice embodiments of the present invention, e.g., program 110, can be stored on such portable computer readable storage media and can be loaded onto persistent storage 608 via I/O interface(s) 612. I/O interface(s) 612 also connect to a display 620.

Display 620 provides a mechanism to display data to a user and may be, for example, a computer monitor, a touch screen, or an HMI display.

The present invention may be a system, a method, and/or a computer program product. The computer program product may include a computer readable storage medium (or media) having computer readable program instructions thereon for causing a processor to carry out aspects of the present invention.

The computer readable storage medium can be any tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, programmable logic controller (PLC), field-programmable gate arrays (FPGA), or programmable logic arrays (PLA) may execute the computer readable program instructions by utilizing state information of the computer readable program instructions to personalize the electronic circuitry, in order to perform aspects of the present invention. Furthermore, programing languages for a PLC may include ladder diagrams, function block diagrams (FBD), statement lists, and logic functions.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, a segment, or a portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A method of removing gas interference and gas locking in a pump, the method comprising:

setting the pump into a gas interference condition, wherein the gas interference condition includes a variable speed drive driving the pump at a first frequency and a choke valve set at a first restriction value, the choke valve located along a flowline downstream from a pump discharge of the pump; and adjusting the choke valve to a second restriction value and the variable speed drive to a second frequency, wherein the second restriction value produces a greater pressure within the flowline upstream from the choke valve than the first restriction value, wherein the second frequency is greater than the first frequency, and wherein adjusting restriction of the choke valve to the second position and the variable speed drive to the second frequency produces a backpressure that keeps fluids drawn by the pump at a single-phase flow.

2. The method of claim 1, wherein the second restriction value and the second frequency corresponds to a pump intake pressure of the pump that is equal to or above the pump intake pressure of the pump during which a gas lock condition of the pump occurred when the choke valve was at the first restriction value.

3. The method of claim 1, wherein the choke valve and the variable speed drive are adjusted simultaneously.

4. The method of claim 1, wherein the choke valve is adjusted manually on-site by a user.

5. The method of claim 1, wherein the choke valve is at least one of an electromechanical valve and a pneumatic valve that is controlled remotely by a computing device.

6. The method of claim 1, wherein the choke valve is a hydraulic valve that is controlled remotely by a computing device.

7. The method of claim 1, wherein the pump is an electrical submersible pump.

8. The method of claim 1, wherein the pump is a long-stroke pumping system.

9. The method of claim 1, wherein the pump is a progressive cavity pump.

* * * * *